US007507151B1

(12) United States Patent
Parker et al.

(10) Patent No.: US 7,507,151 B1
(45) Date of Patent: Mar. 24, 2009

(54) HIGH EFFICIENCY SOLAR POWERED FAN

(75) Inventors: Danny S. Parker, Cocoa Beach, FL (US); Bart Hibbs, Simi Valley, CA (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 20 days.

(21) Appl. No.: 11/433,888

(22) Filed: May 12, 2006

(51) Int. Cl.
*F24F 7/02* (2006.01)
*F24F 7/06* (2006.01)
*F24F 13/20* (2006.01)

(52) U.S. Cl. ..... 454/368; 454/341; 454/356; 454/366; 454/900

(58) Field of Classification Search ..... 454/292, 454/366, 367, 368, 900, 341, 354, 356
See application file for complete search history.

(56) References Cited

U.S. PATENT DOCUMENTS

| | | | | | |
|---|---|---|---|---|---|
| 1,903,823 | A | | 4/1933 | Lougheed | |
| 1,942,688 | A | | 1/1934 | Davis | 244/12 |
| 2,283,956 | A | | 5/1942 | Smith | 170/159 |
| 2,345,047 | A | | 3/1944 | Houghton | 170/162 |
| 2,350,939 | A | | 6/1944 | Sprouse | 230/134 |
| 2,430,225 | A | * | 11/1947 | Hagler | 417/423.15 |
| 2,450,440 | A | | 10/1948 | Mills | |
| 2,777,382 | A | * | 1/1957 | Solzman | 454/341 |
| 3,173,490 | A | | 3/1965 | Stuart, III | 170/159 |
| 3,416,725 | A | * | 12/1968 | Bohanon | 415/222 |
| 3,854,845 | A | | 12/1974 | Van De Water | 416/228 |
| D242,616 | S | | 12/1976 | Meyerhoff et al. | D12/214 |
| 4,150,919 | A | | 4/1979 | Matucheski | 416/93 R |
| 4,197,057 | A | | 4/1980 | Hayashi | 416/242 |
| D261,803 | S | | 11/1981 | Bohanon, Jr. | D23/163 |

(Continued)

FOREIGN PATENT DOCUMENTS

AU 19987 * 0/1928

OTHER PUBLICATIONS

Solar Dynamics Online Publication—Solar Attic Fan Benefits, dated Feb. 8, 2005, and Solar Attic Fan Technical Information, dated Mar. 8, 2005.*

(Continued)

*Primary Examiner*—Steven B McAllister
*Assistant Examiner*—Patrick F. O'Reilly, III
(74) *Attorney, Agent, or Firm*—Brian S. Steinberger; Law Offices of Brian S. Steinberger, P.A.

(57) ABSTRACT

Highly efficient ventilation fans for exhausting air out from underneath roofs, and/or for being portable in use and application. The fan can include optimized airflow blades having a twisted configuration that can move at a rotational speed operation of up to approximately 500 rpm. The approximately 15 inch diameter twisted blades can be premolded on a hub that together form a single molded unit of plastic. They can also be fabricated using metal. The unit can be mounted in an exhaust outlet having a conical diffuser on or adjacent to a roof. Alternatively, the fan can be portable for use most anywhere there is a need for ventilation and moving of air. The blades can rotate by a solar powered motor, where the blades and motor can generate up to approximately 1040 cfm while using no more than approximately 16 Watts.

19 Claims, 14 Drawing Sheets

U.S. PATENT DOCUMENTS

| | | | | | |
|---|---|---|---|---|---|
| 4,325,675 | A | | 4/1982 | Gallot | 416/223 |
| 4,411,598 | A | | 10/1983 | Okada | 416/223 |
| 4,416,434 | A | | 11/1983 | Thibert et al. | 244/35 |
| 4,501,194 | A | | 2/1985 | Brown | 98/42.07 |
| 4,633,769 | A | * | 1/1987 | Milks | 454/117 |
| 4,730,985 | A | | 3/1988 | Rothman et al. | 416/228 |
| 4,844,698 | A | | 7/1989 | Gornstein et al. | 416/223 |
| 4,974,633 | A | * | 12/1990 | Hickey | 137/561 R |
| 5,078,047 | A | | 1/1992 | Wimberly | 454/368 |
| 5,114,313 | A | | 5/1992 | Vorus | 416/93 |
| 5,131,888 | A | | 7/1992 | Adkins, II | 454/343 |
| 5,253,979 | A | | 10/1993 | Fradenburgh et al. | 416/223 |
| 5,588,909 | A | | 12/1996 | Ferng | 454/141 |
| 5,620,368 | A | * | 4/1997 | Bates et al. | 454/186 |
| 6,039,533 | A | * | 3/2000 | McCabe | 415/146 |
| 6,039,541 | A | | 3/2000 | Parker et al. | 416/223 |
| 6,306,030 | B1 | | 10/2001 | Wilson | 454/16 |
| 6,481,233 | B1 | * | 11/2002 | Calvert | 62/314 |
| 6,659,721 | B1 | | 12/2003 | Parker et al. | 416/5 |
| 6,695,692 | B1 | | 2/2004 | York | 454/199 |
| 6,733,241 | B2 | | 5/2004 | Bird | 416/238 |
| 6,884,034 | B1 | | 4/2005 | Parker et al. | 416/1 |
| D510,998 | S | | 10/2005 | Parker et al. | D23/411 |
| 7,014,423 | B2 | | 3/2006 | Parker et al. | 415/220 |
| 2004/0165986 | A1 | * | 8/2004 | Parker et al. | 415/220 |

OTHER PUBLICATIONS

HVAC, Exhaust Fans, Attic Ventilators, [online] Grainger.com, Grainger, for the ones who get it done, 3 pages, [retrieved on Apr. 21, 2006] Retrieved from: http://www.grainger.com/Grainger/wwg/productIndex.shtml?operator=searchProductBySu....

HVAC, Exhaust Fans, Attic Ventilators, [online] Grainger.com, Grainger, for the ones who get it done, 3 pages, [retrieved on Apr. 21, 2006] Retrieved from: http://grainger.com/Grainger/wwg/productIndex.shtml?operator=earchProductBySu....

* cited by examiner

FIG. 2A
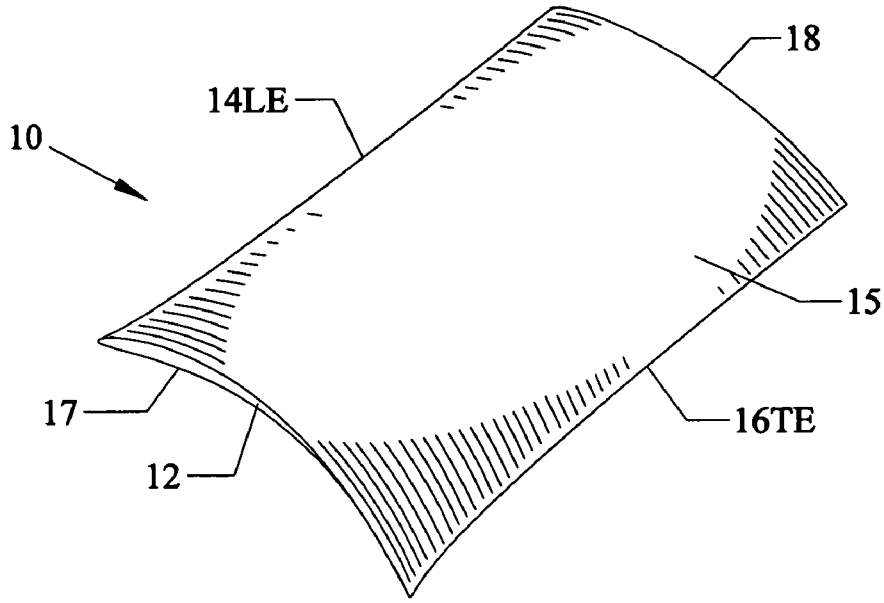
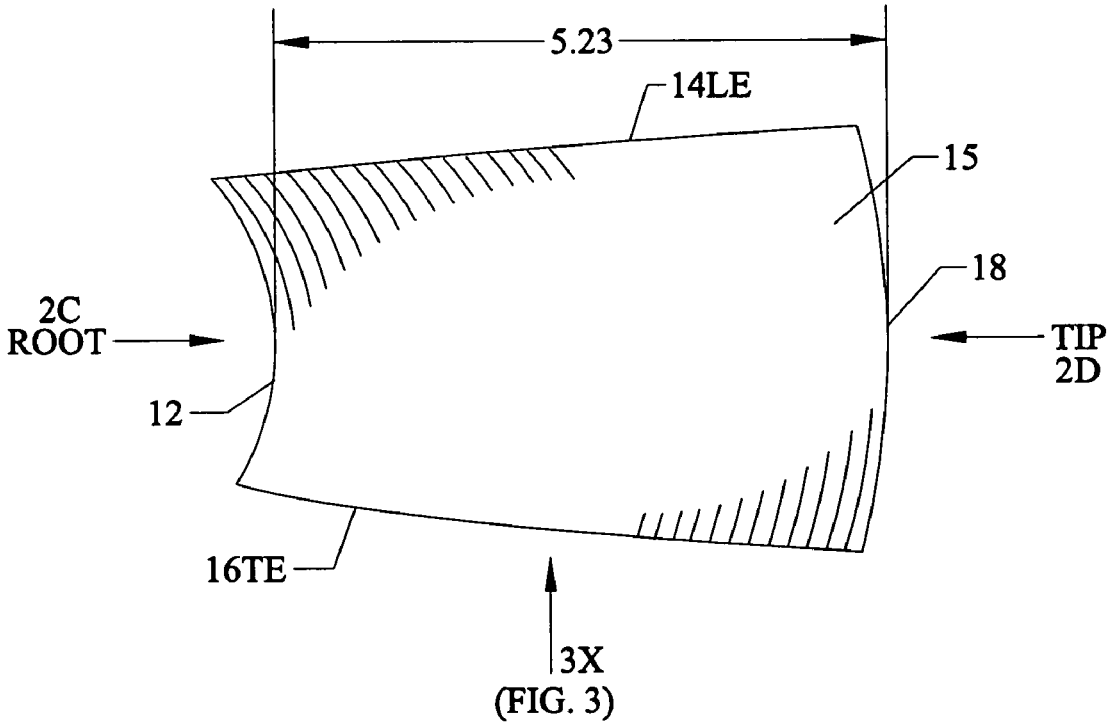
FIG. 2B

FIG. 2E
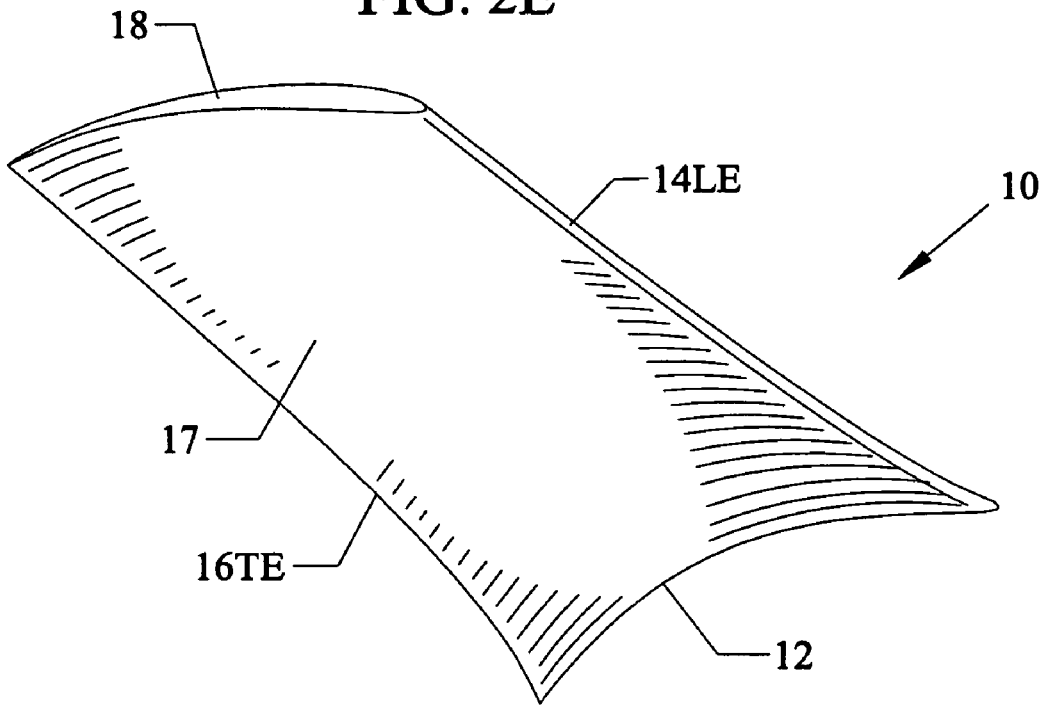
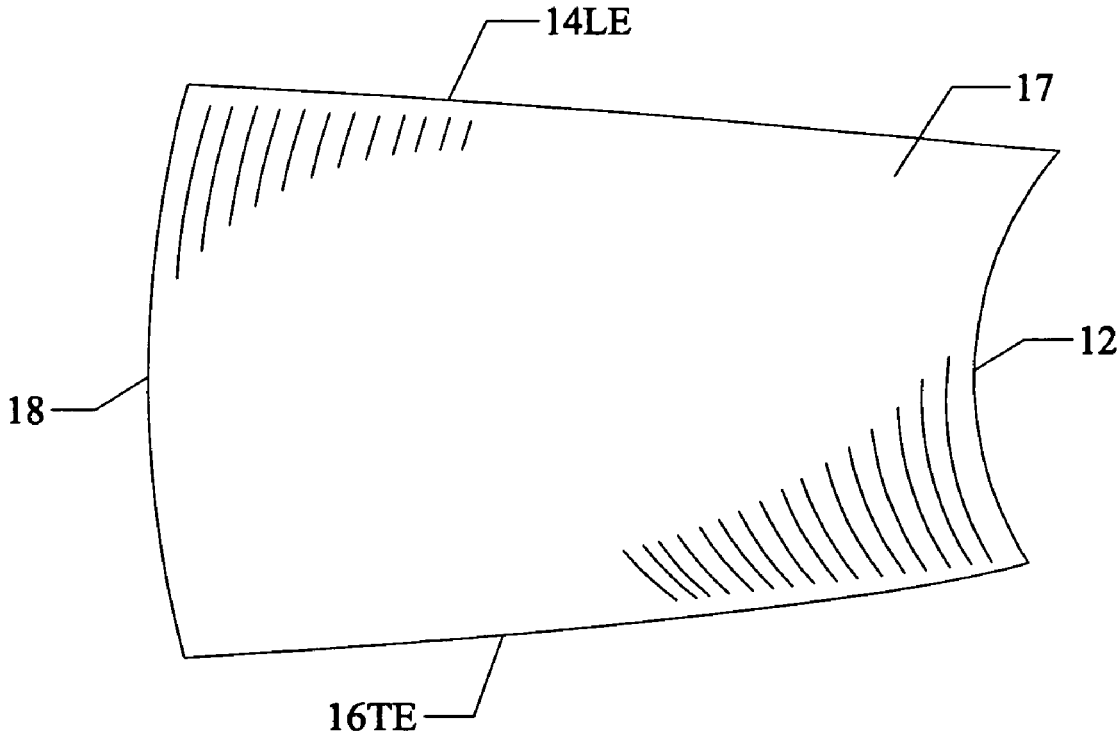
FIG. 2F

HIGH EFFICIENCY SOLAR POWERED FAN

FIELD OF INVENTION

This invention relates to solar powered fans, and in particular to efficient attic exhaust fans and portable fans having optimized twisted nonmetal blades that are solar powered, and to methods of operating the novel fans.

BACKGROUND AND PRIOR ART

Ventilation fans for venting hot air from attic areas underneath roofs have been increasing in popularity over the years. Hot air is known to accumulate under roof tops especially in attic areas. This buildup of hot air can lead to poor cooling conditions within the building and increased utility costs to run air conditioning systems and cooling systems, and the like. Thus, it is desirable to improve and maximize air removal rates from under roofs and from attic spaces, and the like.

Existing attic ventilation fans have been used but have substantial power requirements from existing building electrical supplies. For example, the GRAINGER® catalog sells an automatic power attic gable ventilator model number 4YN78 having metal type blades that rotate at 1050 RPM (revolutions per minute) generating 1320 cfm (cubic feet per minute) and requires 200 Watts of power. Another GRAINGER® attic fan model 4YN77 generates a higher level of cfm (1620 cfm) but requires 225 Watts of power.

Most existing attic ventilation fans use standard stamped generally flat metal fan blades that have only fair air moving performance. Flat type blades are not designed to maximize moving of air.

Various attic type ventilation fans have been proposed over the years. See for example, U.S. Pat. Nos.: Des. 261,803 to Bohanon, Jr.; 4,501,194 to Brown; 5,078,047 to Wimberly; 6,306,030 to Wilson; and 6,695,692 to York. However, none of the cited references, individually or in combination overcome all the problems with the prior art described above.

The inventors and assignee of the subject invention have been at the forefront of inventing high efficiency ceiling fans by using novel twisted blade configurations. See for example, U.S. Pat. Nos: 6,884,034 and 6,659,721 and 6,039,541 to Parker et al. However, these fans are designed for maximizing air flow from ceiling fans that have much larger diameters (approximately 42 inches to 64 inches, etc.) and that operate at different speeds (less than approximately 200 RPM) than a small diameter ventilation fans that are needed to exhaust air from underneath roofs and from attic spaces.

Additionally, the inventors and assignee have worked on air conditioner condenser fans blades (see for example, U.S. Pat. Nos. D510,998 to Parker et al. and 7.014,423 to Parker et al. However, the air conditioner condenser fans are not optimized for the ventilation and removal of air from underneath roofs and from attic spaces.

Aircraft, marine and automobile engine propeller type blades have been altered over the years to shapes other than flat rectangular. See for example, U.S. Pat. Nos. 1,903,823 to Lougheed; 1,942,688 to Davis; 2,283,956 to Smith; 2,345,047 to Houghton; 2,450,440 to Mills; 4,197,057 to Hayashi; 4,325,675 to Gallot et al.; 4,411,598 to Okada; 4,416,434 to Thibert; 4,730,985 to Rothman et al. 4,794,633 to Hickey; 4,844,698 to Gornstein; 5,114,313 to Vorus; and 5,253,979 to Fradenburgh et al.; Australian Patent 19,987 to Eather. However, these patents are generally used for high speed water, aircraft, and automobile applications where the propellers are run at high revolutions per minute (rpm) generally in excess of 500 rpm. None of these propellers are designed for optimizing airflow to remove undesirable air from attics and from underneath roofs.

Portable fans such as handheld battery fans have been used over the years. Similar to the problems presented above, small portable fans do not have blades aerodynamically optimized for airflow.

In addition, portable fans have batteries that have limited lifespans since the batteries either need to be constantly recharged from a 120 volt power supply or the batteries need to be constantly replaced.

The need for efficient powered portable fans has been growing much more in recent years. Natural disasters such as hurricanes and earthquakes have caused extensive power outages that can last from several hours to weeks or more in the United States. Conventional battery powered fans, cannot be used effectively during these disaster conditions. The prior art listed above does not fix the problems with portable fan use.

Thus, the need exists for better performing fans over the prior art.

SUMMARY OF THE INVENTION

The first objective of the subject invention is to provide efficient roof/attic exhaust fans, blades, devices, apparatus and methods of operating the fans, that have optimized twisted nonmetal blades for maximizing removal of air from spaces underneath roofs.

The second objective of the subject invention is to provide efficient roof/attic exhaust fans, blades, devices, apparatus and methods of operating the fans, that can be solar powered.

The third objective of the subject invention is to provide efficient roof/attic exhaust fans, blades, devices, apparatus and methods of operating the fans, that can generate air flow up to at least approximately 30% above existing ventilation fans.

The fourth objective of the subject invention is to provide efficient roof/attic exhaust fans, blades, devices, apparatus and methods of operating the fans, that moves more air than existing ventilation fans and requires less power than existing ventilation fans. The invention reduces electrical power consumption and is more energy efficient over traditional flat planar ceiling fan blades.

The fifth objective of the subject invention is to provide efficient roof/attic exhaust fans, blades, devices, apparatus and methods of operating the fans, having fan blade aerodynamics optimized to maximize airflow in an approximately 15 inch diameter fan operating at up to approximately 500 (revolutions per minute) RPM.

The sixth objective of the subject invention is to provide efficient roof/attic exhaust fans, blades, devices, apparatus and methods of operating the fans, where the blades and hub are a single molded piece of plastic.

The seventh objective of the subject invention is to provide portable fans that can be used anywhere, and blades, devices, apparatus and methods of operating the fans, having optimized twisted nonmetal blades for maximizing air ventilation.

The eighth objective of the subject invention is to provide portable fans that can be used anywhere, and blades, devices, apparatus and methods of operating the fans, that can be solar powered.

The ninth objective of the subject invention is to provide portable fans that can be used anywhere, and blades, devices, apparatus and methods of operating the fans, that can generate air flow up to at least approximately 30% above existing portable fans.

The tenth objective of the subject invention is to provide portable fans that can be used anywhere, and blades, devices, apparatus and methods of operating the fans, that move more air than existing ventilation fans and requires less power than existing ventilation fans. The invention reduces electrical power consumption and is more energy efficient over traditional flat planar ceiling fan blades.

The eleventh objective of the subject invention is to provide portable fans that can be used anywhere, and blades, devices, apparatus and methods of operating the fans, having fan blade aerodynamics optimized to maximize airflow in an approximately 15 inch diameter fan operating at up to approximately 500 (revolutions per minute) RPM.

The twelfth objective of the subject invention is to provide portable fans, blades, devices, apparatus and methods of operating, the fans, that can be used anywhere such as during and after natural disasters such as hurricanes, earthquakes, and the like, as well as in environments having limited power supplies such as in construction sites, at picnics and other outings, on camping, hiking and fishing trips and at the beach.

A preferred embodiment can include a plurality of efficient optimized small diameter fan blades with a hub. Diameter sizes of the fans can include but not be limited to less than and up to approximately 15", and greater. The blades can be made from plastic, and the like, and be pre-molded together with the hub. The blade dimensions and twist angles can be optimized to move air when running at approximately 500 rpm (revolutions per minute).

The solar powered fans can be used in attics and under roofs to ventilate and/or exhaust heated air therefrom.

Another embodiment has the solar powered fan being portable so that it can be used most anywhere there is a need for moving and circulating air. The fan can be moveable by a wheeled stand, and the solar powered panels can be movable by a hand truck, and the like.

Further objects and advantages of this invention will be apparent from the following detailed descriptions of the presently preferred embodiments which are illustrated schematically in the accompanying drawings.

BRIEF DESCRIPTION OF THE FIGURES

FIG. 2A is an upper top perspective view of a single twisted blade of FIGS. 1A-1C.

FIG. 2B is a top view of the single twisted blade of FIG. 2A.

FIG. 2E is a lower bottom perspective view of the twisted blade of FIG. 2A.

FIG. 2F is a bottom view of the twisted blade of FIG. 2E.

DESCRIPTION OF THE PREFERRED EMBODIMENT

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

The labeled components will now be described.

Figure 1B:
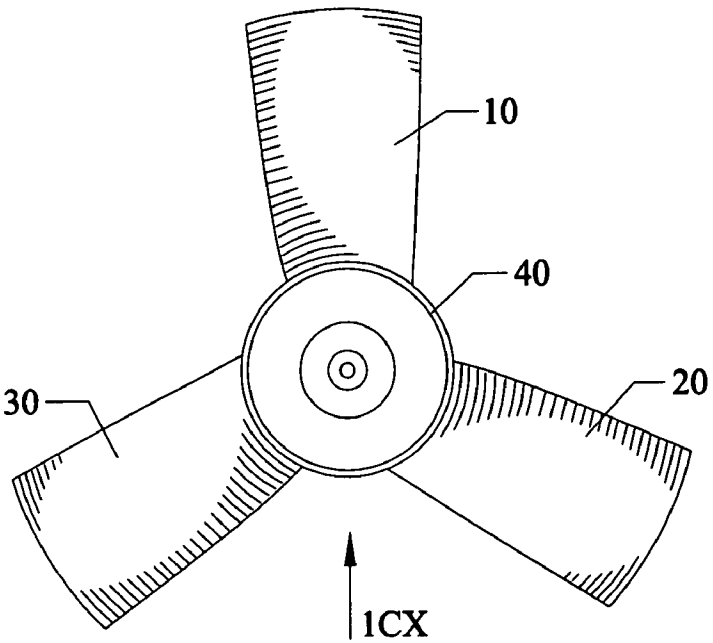
FIG. 1B is a bottom view of the blades with hub of FIG. 1A.
Figure 1C:
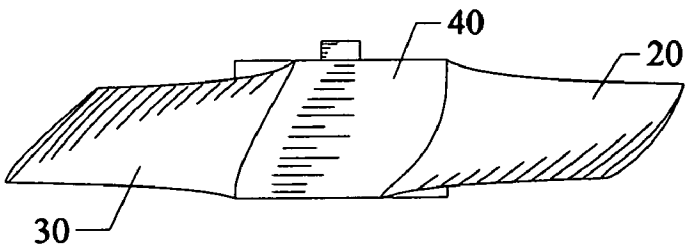
FIG. 1C is a side view of the blades and hub of FIG. 1B along arrow 1CX.
Figure 1A:
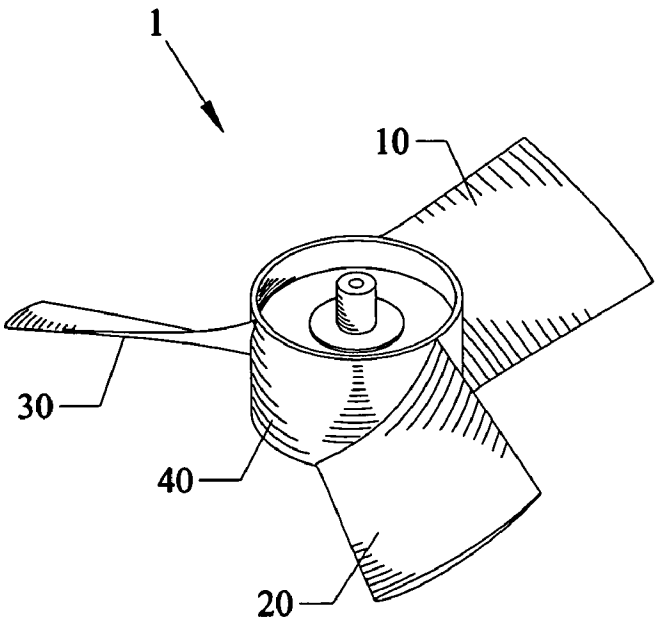
FIG. 1A is a perspective view of the novel three twisted blades with hub that can be used with an attic fan.

1 hub and blade assembly
10 First blade
20 Second blade
30 Third blade
40 Hub
50 Motor
55 Power line
12 Root end of blade
18 Tip end of blade
14LE leading edge of blade
16TE trailing edge of blade
15 upper surface of blade
17 lower surface of blade
100 Solar power source
110, 120 PV (photovoltaic panels)
130 Solar panel frame
140 Optional stand
150 Optional Additional panels, frame and stand
200 Rood Alcove Exhaust
210 Roof
215 Opening in roof
220 Gable wall
225 Opening in gable wall
230 Hood
235 Louvers
240 housing
300 Roof Top Exhaust
330 Domed hood cover
335 Lower Opening about overhanging edges of Dome Cover
340 Housing under roof
350 Cylindrical Housing outside of roof
400 Portable Fan
410 Cylinder cover
420 pole
430 triangular base
440 wheels
450 Stand handle
460 fan speed control
470 Solar panels
475 cable/power line
480 handtruck
490 battery power source
495 cable/powerline FIG. 1A is a perspective view 1 of the novel three twisted blades 10, 20, 30 with hub 40 that can be used with an attic fan. FIG. 1B is a bottom view of the blades 10-30 with hub 40 of FIG. 1A. FIG. 1C is a side view of the blades 10-30 and hub 40 of FIG. 1B along arrow 1CX.

Figure 2D:
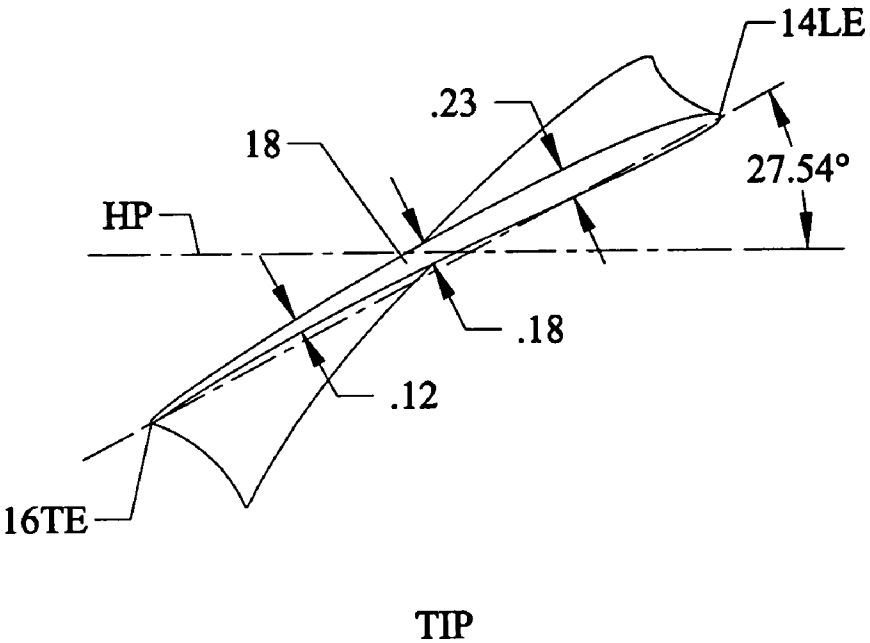
FIG. 2D is a top end view of the single twisted blade of FIG. 2B along arrow 2D.
Figure 2C:
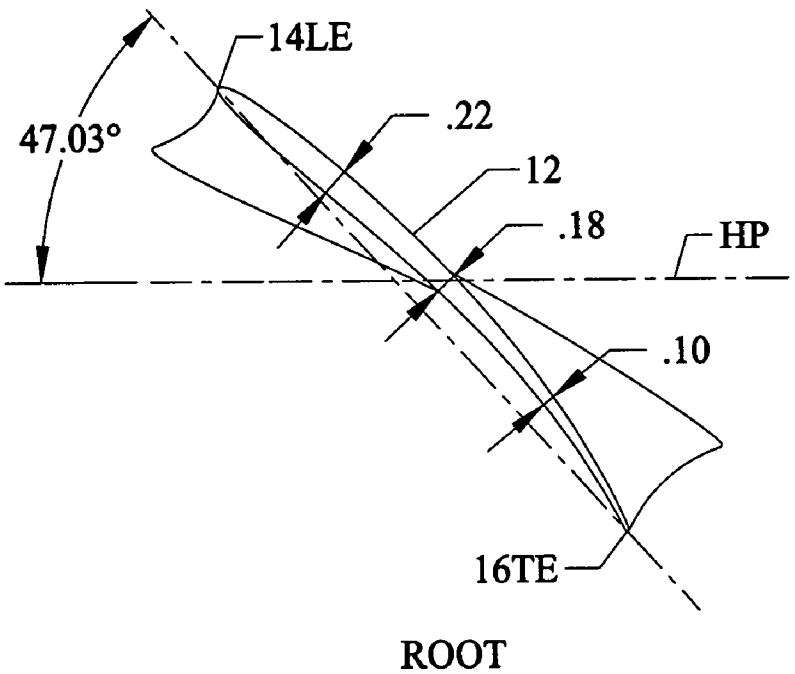
FIG. 2C is a root end view of the single twisted blade of FIG. 2B along arrow 2C.

FIG. 2A is an upper top perspective view of a single twisted blade 10 of FIGS. 1A-1C. FIG. 2B is a top view of the single twisted blade 10 of FIG. 2A. FIG. 2C is a root end view of the single twisted blade 10 of FIG. 2B along arrow 2C. FIG. 2D is a tip end view of the single twisted blade 10 of FIG. 2B along arrow 2D. FIG. 2E is a lower bottom perspective view of the twisted blade 10 of FIG. 2A. FIG. 2F is a bottom view of the twisted blade 10 of FIG. 2E.

Referring to FIGS. 1-2F, the novel fan can have three twisted blades 10, 20, 30 each having a positive twist between their root ends adjacent to the hub 40 and their tip ends. The overall diameter of the fan 1 can be approximately 15 inches across the blade tip ends. The blades 10, 20, 30 and hub 40 can be formed into a single molded unit, such as being formed from injection molded plastic, and the like.

Referring to FIGS. 2B-2D, the single twisted blade 10 can have a length of approximately 5.23 inches between the root end 12 and the tip end 18. The twisted blade 10 can be attached to the hub 40 of FIGS. 1A-1C with the leading edge 14LE of the root end 12 having an raised angle of approximately 47.03 degrees above horizontal plane HP with the trailing edge 16TE of the root end 12 being below the horizontal plane HP. The tip end 18 of the blade 10 can have a twist from the root end so that the leading edge 14LE is approximately 27.54 degrees above the horizontal plane HP with the trailing edge 16TE below the horizontal plane HP.

Figure 3:
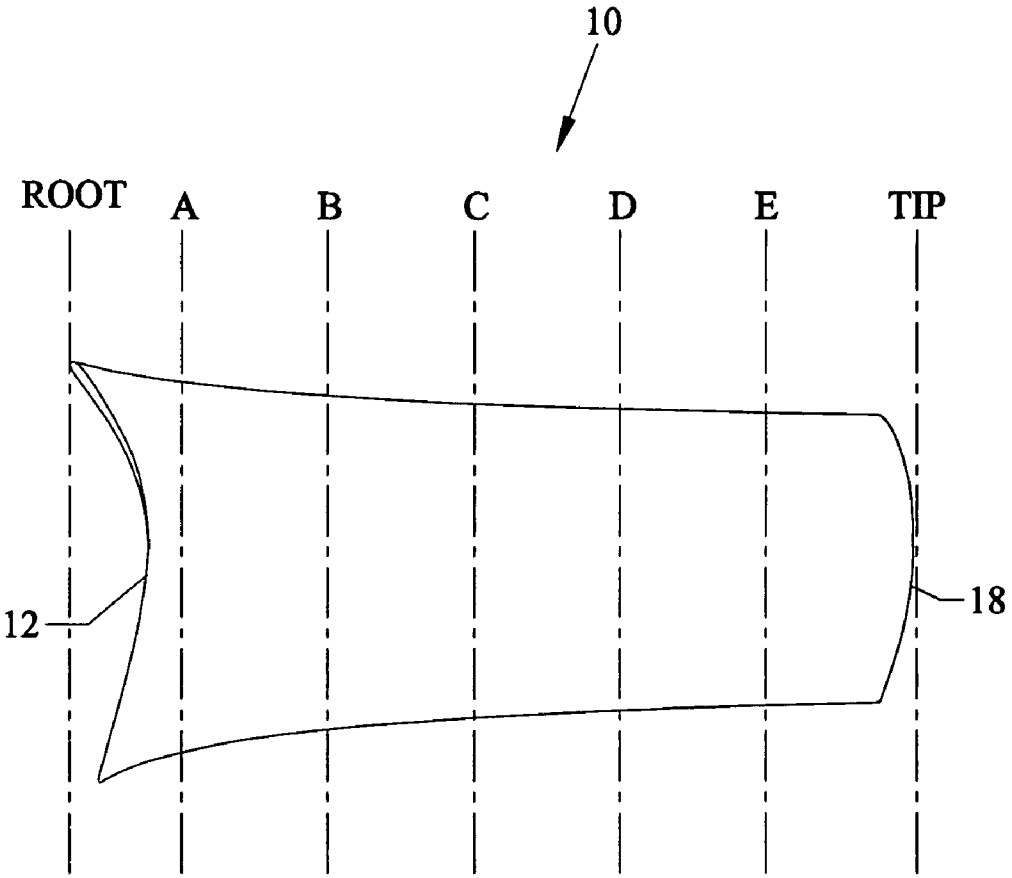
FIG. 3 is a side perspective view of the twisted blade of FIG. 2B along arrow 3X with labeled cross-sections A, B, C, D, E.
Figure 4:
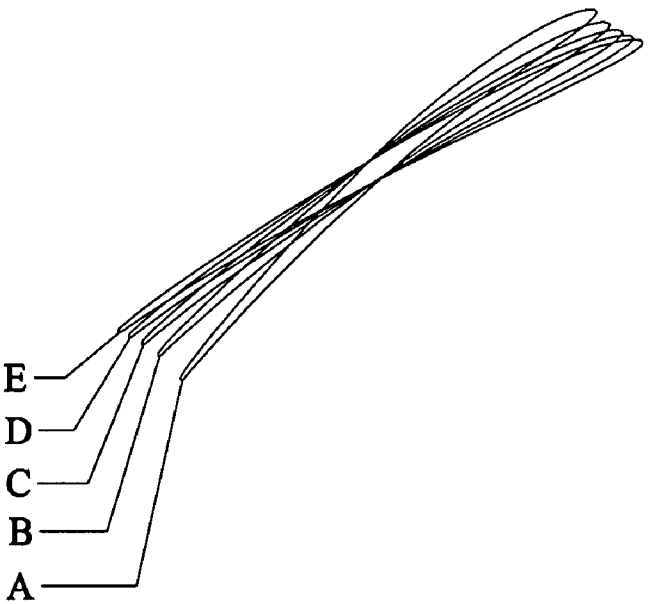
FIG. 4 is an end view of FIG. 3 showing the different cross-sections A, B, C, D, and E.

FIG. 3 is a side perspective view of the blade of FIG. 2B along arrow 3X with labeled cross-sections A, B, C, D, E in between the root end 12 and tip end 18. FIG. 4 is an end view of FIG. 3 showing the different cross-sections A, B, C, D, and E, in curved views superimposed over one another showing the varying degrees of twist between the root end and tip end of the blade 10.

Figure 5A:
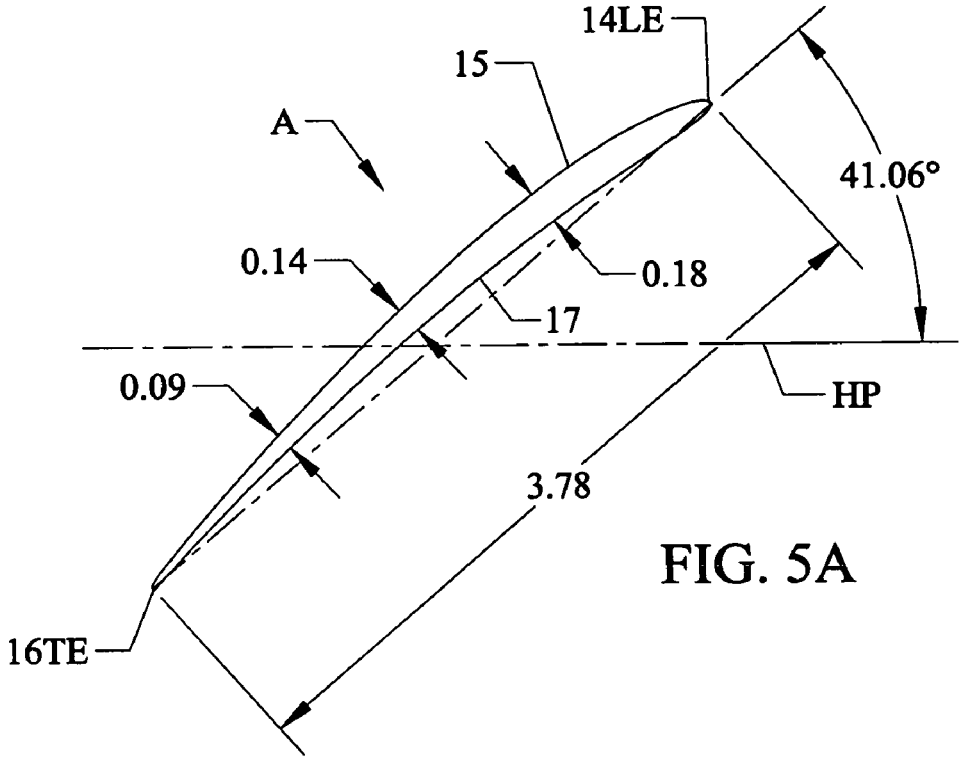
FIG. 5A shows the cross-section A of FIGS. 3-4.

FIG. 5A shows the cross-section A of FIGS. 3-4 having a leading edge 14LE slightly curved down being approximately 41.06 degrees above the horizontal plane HP. Cross-section A has a convex shaped upper surface 15 and a lower surface 17 with a concave bend configuration, and trailing edge 16TE below the horizontal plane HP. The leading edge 14LE having a more blunt rounded edge than the trailing edge 16TE. Cross-section A can have a width of approximately 3.78 inches between the trailing edge 16TE and leading edge 14LE. The thickness of the cross-section A can expand from the trailing edge 16TE to being approximately 0.09 inches half way to a midpoint of the cross-section which has a thickness of approximately 0.14 inches, and the thickness halfway between the midpoint and the leading edge 14LE being approximately 0.18 inches.

Figure 5B:
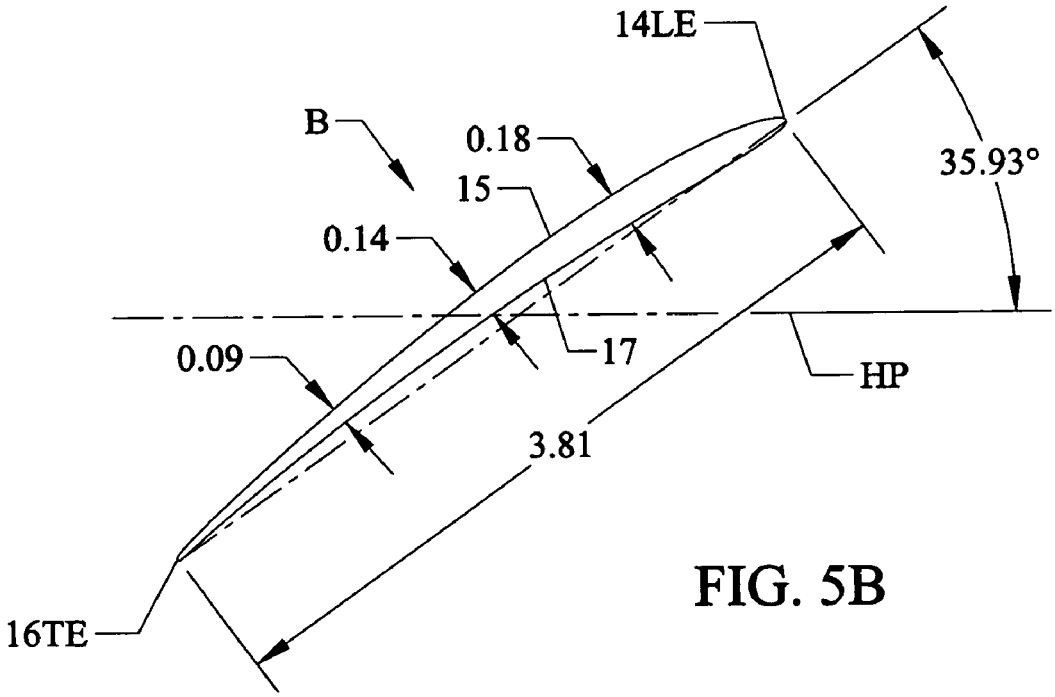
FIG. 5B shows the cross-section B of FIGS. 3-4.

FIG. 5B shows the cross-section B of FIGS. 3-4 having a leading edge 14LE slightly curved down being approximately 35.93 degrees above the horizontal plane HP. Cross-section B has a convex shaped upper surface 15 and a lower surface 17 with a concave bend configuration, and trailing edge 16TE below the horizontal plane HP. The leading edge 14LE having a more blunt rounded edge than the trailing edge 16TE. Cross-section B can have a width of approximately 3.81 inches between the trailing edge 16TE and leading edge 14LE. The thickness of the cross-section B can expand from the trailing edge 16TE to being approximately 0.09 inches half way to a midpoint of the cross-section which has a thickness of approximately 0.14 inches, and the thickness halfway between the midpoint and the leading edge 14LE being approximately 0.18 inches.

Figure 5C:
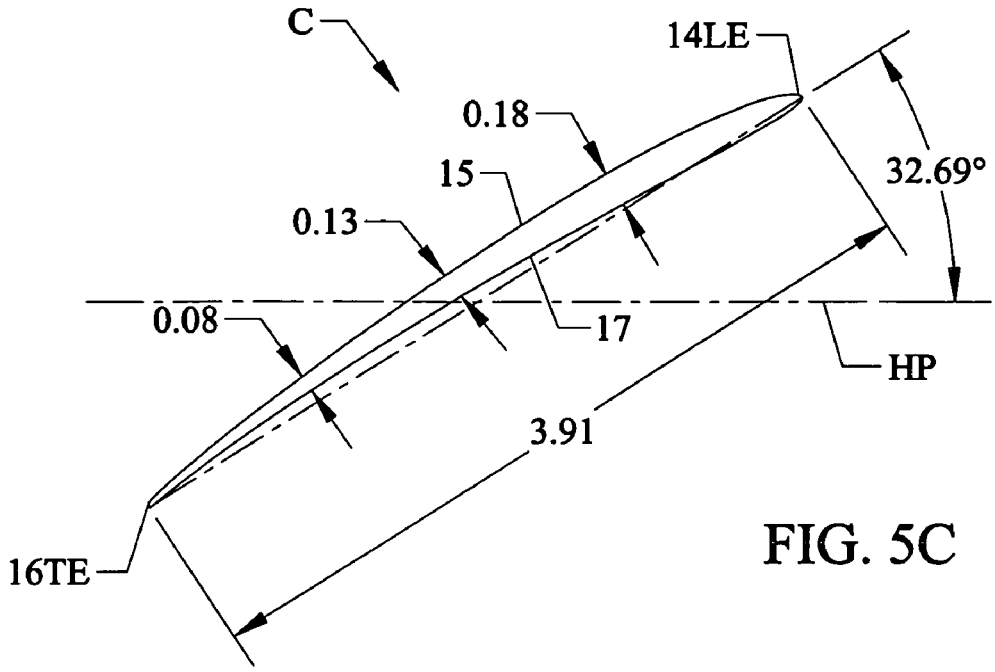
FIG. 5C shows the cross-section C of FIGS. 3-4.

FIG. 5C shows the cross-section C of FIGS. 3-4 having a leading edge 14LE slightly curved down being approximately 32.69 degrees above the horizontal plane HP. Cross-section C has a convex shaped upper surface 15 and a lower surface 17 with a concave bend configuration, and trailing edge 16TE below the horizontal plane HP. The leading edge 14LE having a more blunt rounded edge than the trailing edge 16TE. Cross-section C can have a width of approximately 3.91 inches between the trailing edge 16TE and leading edge 14LE. The thickness of the cross-section C can expand from the trailing edge 16TE to being approximately 0.08 inches half way to a midpoint of the cross-section which has a thickness of approximately 0.13 inches, and the thickness halfway between the midpoint and the leading edge 14LE being approximately 0.18 inches.

Figure 5D:
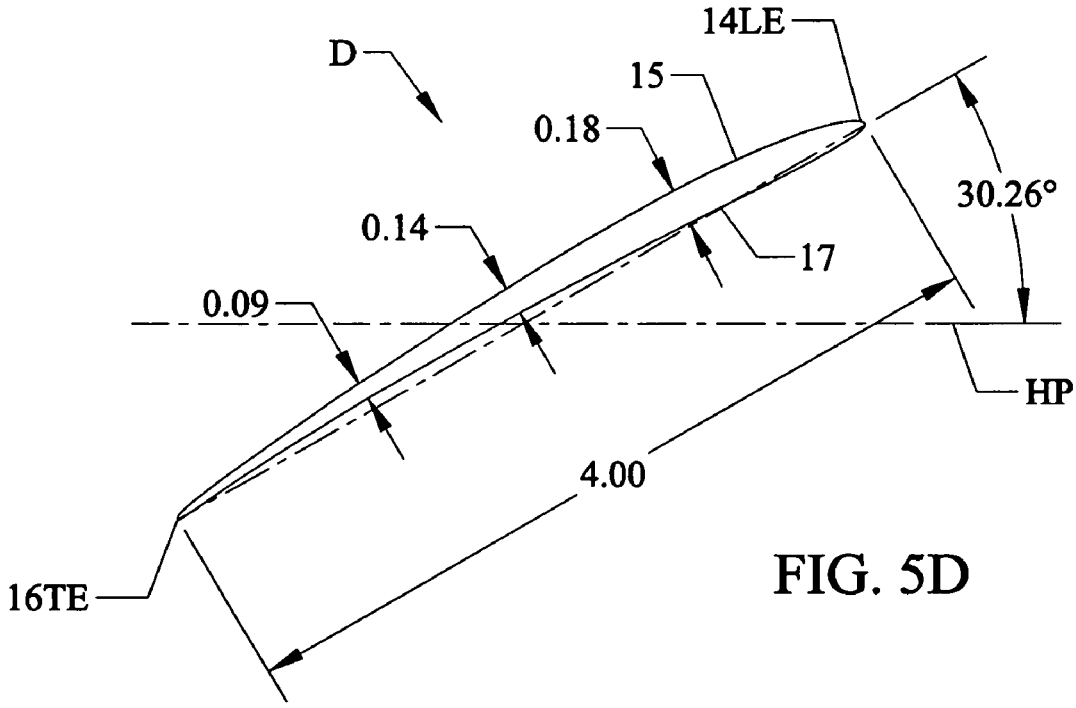
FIG. 5D shows the cross-section D of FIGS. 3-4.

FIG. 5D shows the cross-section D of FIGS. 3-4 having a leading edge 14LE slightly curved down being approximately 30.26 degrees above the horizontal plane HP. Cross-section D has a convex shaped upper surface 15 and a lower surface 17 with a concave bend configuration, and trailing edge 16TE below the horizontal plane HP. The leading edge 14LE having a more blunt rounded edge than the trailing edge 16TE. Cross-section D can have a width of approximately 4.0 inches between the trailing edge 16TE and leading edge 14LE. The thickness of the cross-section D can expand from the trailing edge 16TE to being approximately 0.09 inches half way to a midpoint of the cross-section which has a thickness of approximately 0.14 inches, and the thickness halfway between the midpoint and the leading edge 14LE being approximately 0.18 inches.

Figure 5E:
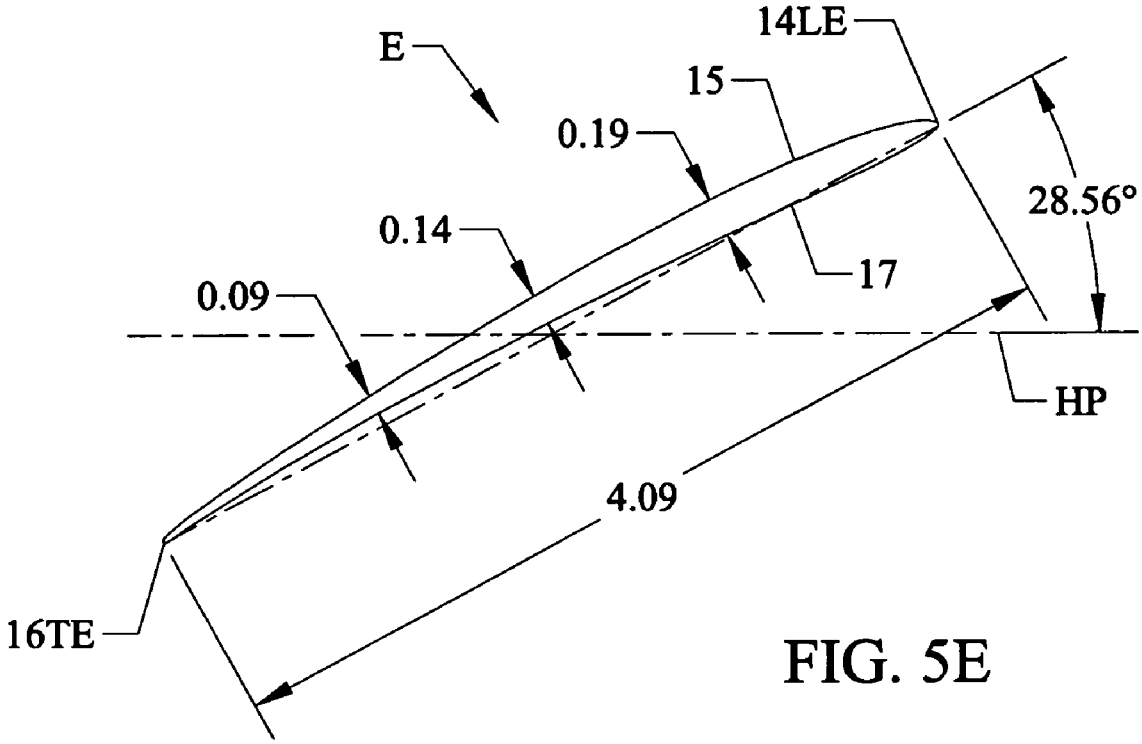
FIG. 5E shows the cross-section E of FIGS. 3-4.

FIG. 5E shows the cross-section E of FIGS. 3-4 having a leading edge 14LE slightly curved down being approximately 28.56 degrees above the horizontal plane HP. Cross-section E has a convex shaped upper surface 15 and a lower surface 17 with a concave bend configuration, and trailing edge 16TE below the horizontal plane HP. The leading edge 14LE having a more blunt rounded edge than the trailing edge 16TE. Cross-section E can have a width of approximately 4.09 inches between the trailing edge 16TE and leading edge 14LE. The thickness of the cross-section E can expand from the trailing edge 16TE to being approximately 0.09 inches half way to a midpoint of the cross-section which has a thickness of approximately 0.14 inches, and the thickness halfway between the midpoint and the leading edge 14LE being approximately 0.19 inches.

Roof Alcove Exhaust

Figure 6:
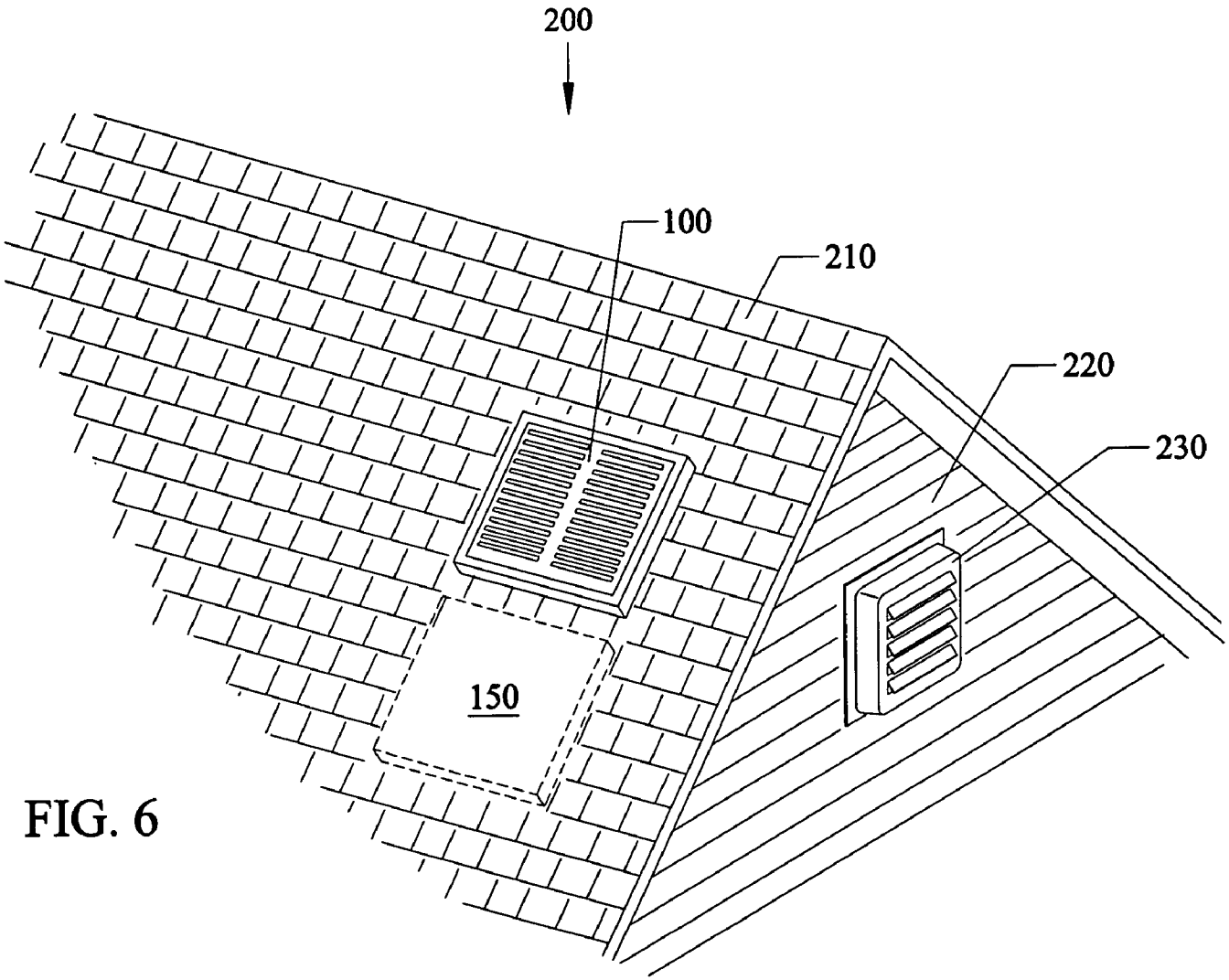
FIG. 6 is a perspective exterior view of a roof alcove exhaust incorporating the fan and blades of the preceding figures with a solar power source.
Figure 7:
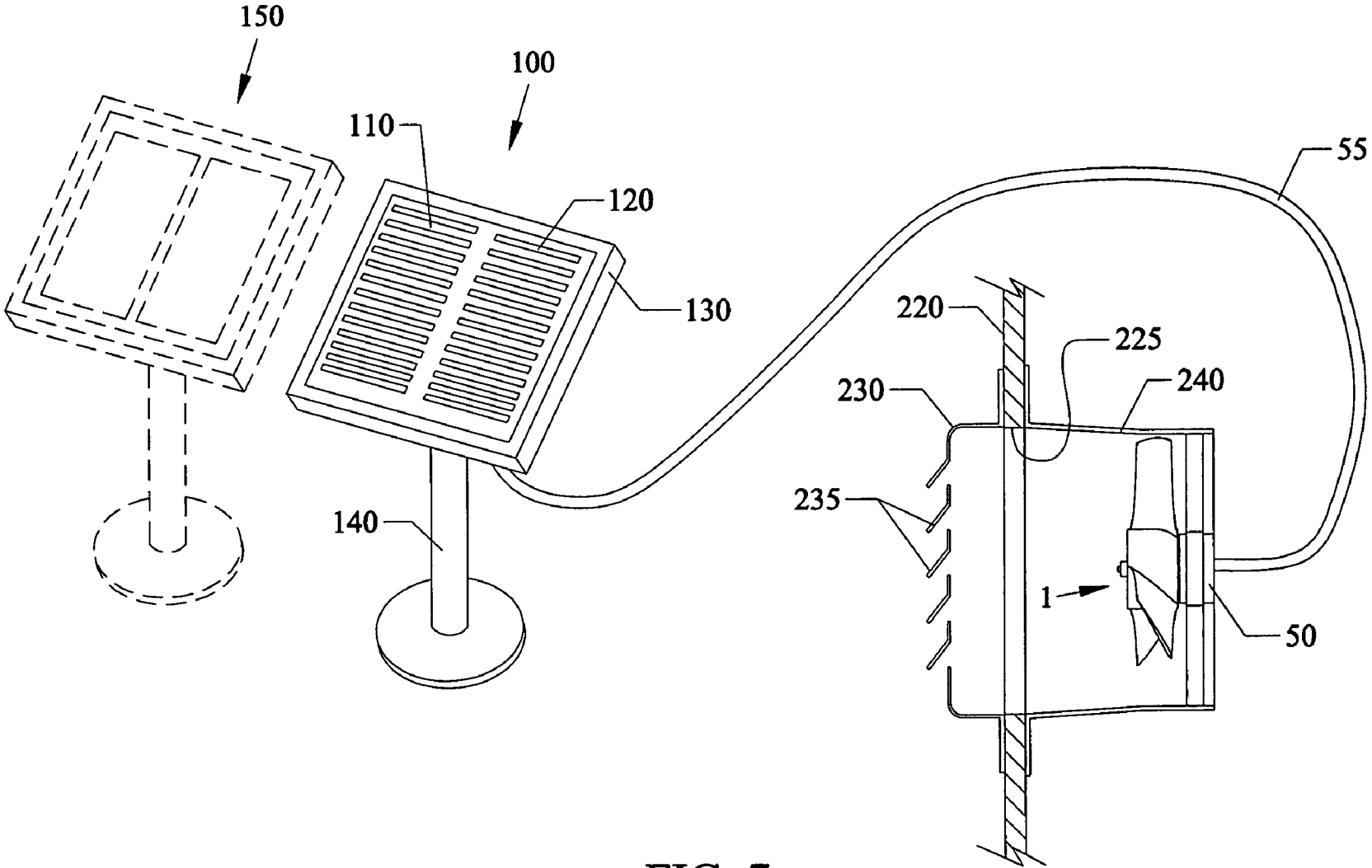
FIG. 7 is a view of the separate components of FIG. 6.

FIG. 6 is a perspective exterior view of a roof alcove exhaust embodiment 200 incorporating the fan 1 and blades 10, 20, 30 of the preceding figures with a solar power source 100. FIG. 7 is a view of the separate components of FIG. 6.

Referring to FIGS. 6-7, the novel fan 1 can be mounted with blades 10-30 facing to exhaust sideways in a housing 240 inside of an opening 225 in a gable side wall 220 below a roof 210. The outer hood 230 with covers 235 can cover the opening 225 in the gable side wall 220. The fan motor 50 can draw power through cable/power line 55 from a rooftop mounted solar power source 100, which can include two PV (photovoltaic) panels 110, 120 in a frame 130 that can be directly attached (by screws, and the like) into the roof 210. An optional stand 140 can be used to elevate the solar panels 110, 120 and frame 130 above the roof 210. Additional power can be provided by another solar power source 150.

Roof Top Exhaust

Figure 8:
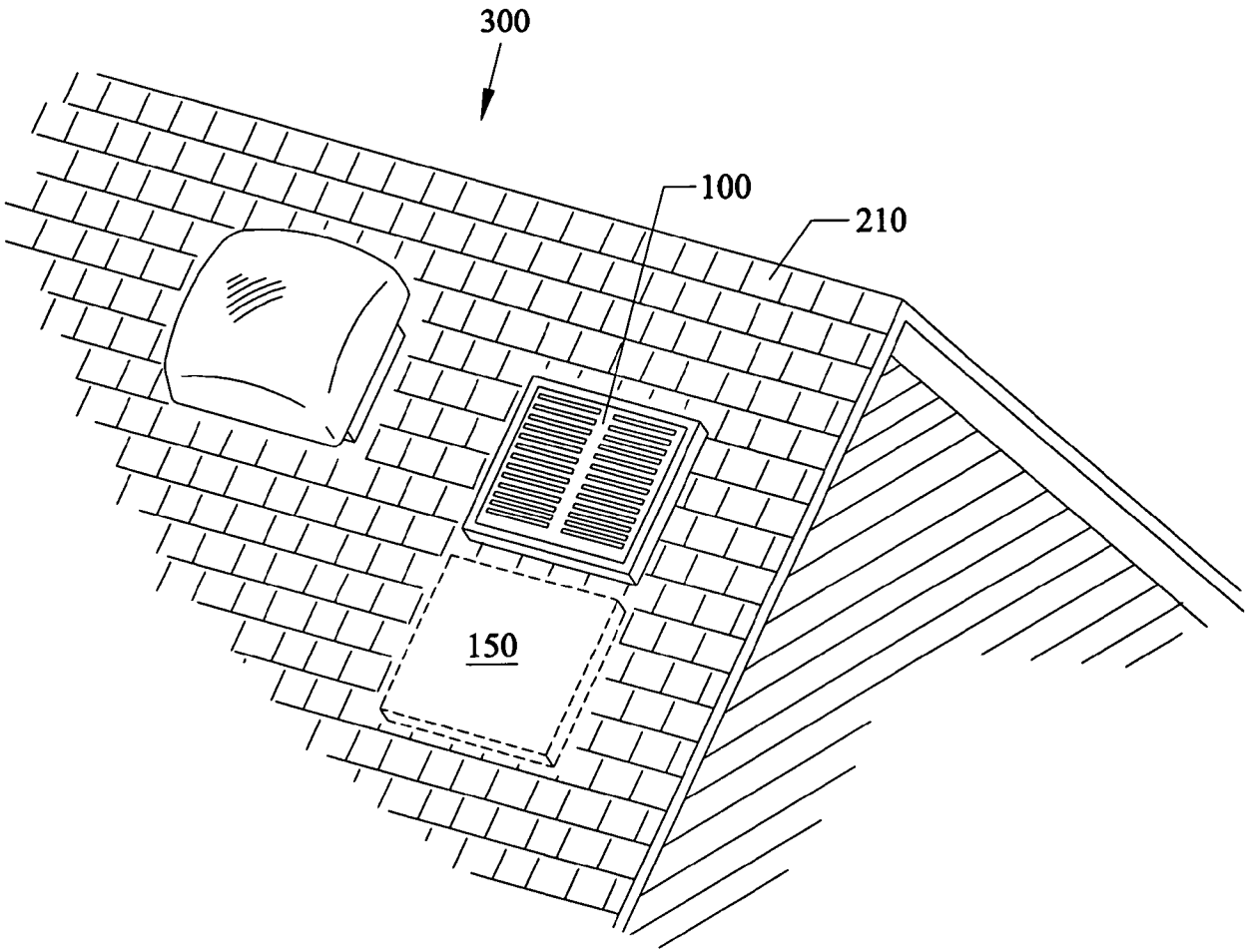
FIG. 8 is another perspective exterior view of a roof top exhaust incorporating the fan and blades of the preceding figures with a solar power source.
Figure 9:
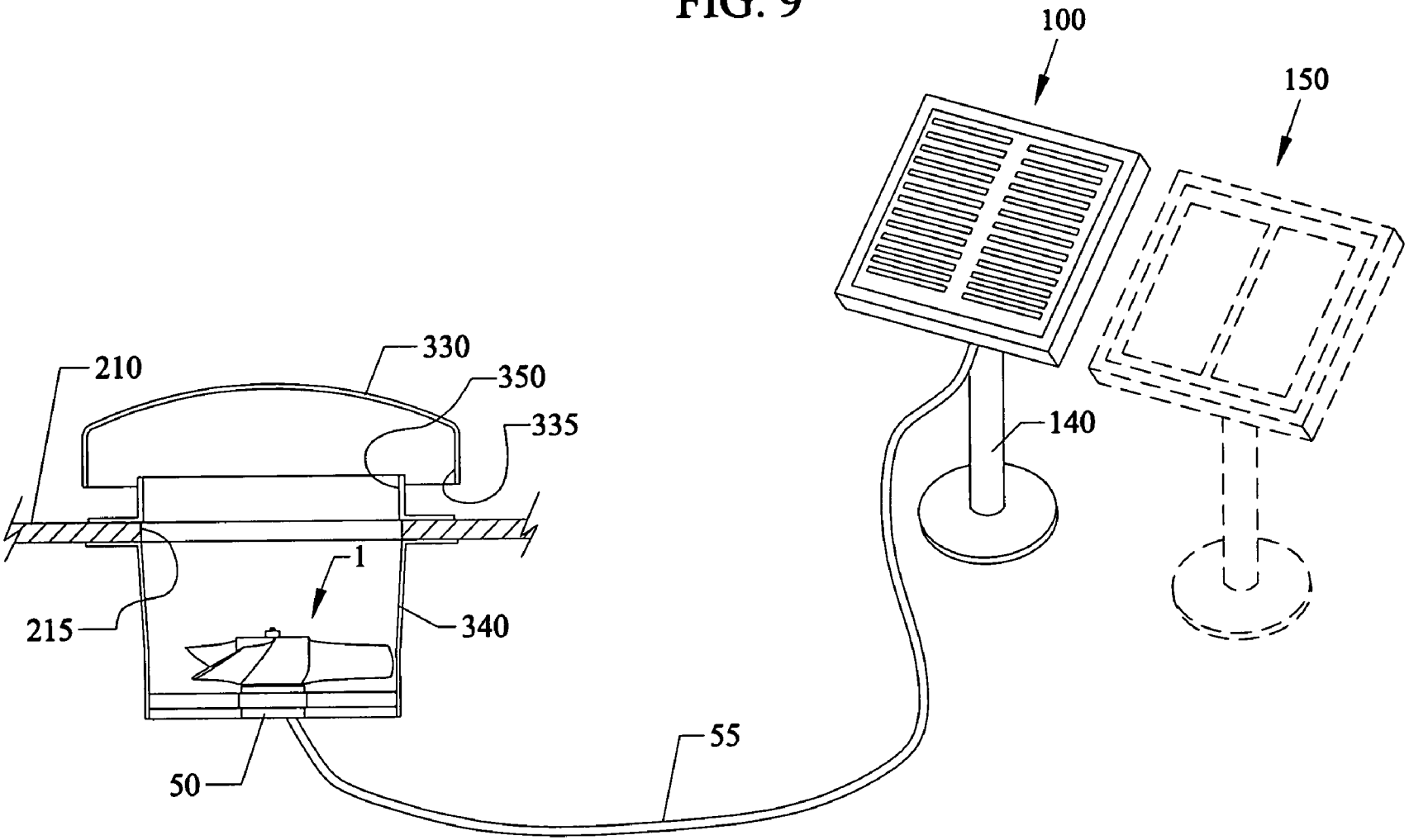
FIG. 9 is a view of the separate components of FIG. 8.

FIG. 8 is another perspective exterior view of a roof top exhaust 300 incorporating the fan 1 and blades 10, 20, 30 of the preceding figures with a solar power source 100. FIG. 9 is a view of the separate components of FIG. 8.

Referring to FIGS. 8-9, the novel fan 1 can be mounted with blades 10-30 facing to upward in a housing 340 underneath an opening 215 in roof 210. The domed hood cover 330 can overhand a cylindrical housing 350 outside roof 210 having side edges which overhang the housing 350 with an exhaust opening 335 thereunder. Similar to FIGS. 6-7, the fan motor 50 can draw power through cable/power line 55 from a rooftop mounted solar power source 100, which can include two PV (photovoltaic) panels 110, 120 in a frame 130 that can be directly attached (by screws, and the like) into the roof 210. An optional stand 140 can be used to elevate the solar panels 110, 120 and frame 130 above the roof 210. Additional power can be provided by another solar source 150.

Testing of the solar powered fan will now be described. A single 10 W panel with an open circuit voltage of approximately 14 to approximately 15 vdc (volts direct current) was connected to the fan 1 previously described having twisted blades 10, 20, 30.

A conventional fan was compared to the novel fan 1 of the invention with the results shown in Table 1. The conventional fan tested was a KING OF FNS® Solar Gable Ventilation Fan (22-607-690) using a Brushless DC motor: BOM-ZYW 92/22A-03). The conventional fan used a 15 inch metal blade operating at 7.3 vdc (Volts DC current)@835 mA (milliamps).

The novel improved fan and diffuser used novel twisted blades and a diffuser housing (described more fully below) and used the same DC motor as that of the conventional fan and operated at 7.6 vdc@915 mA.

The conventional fan got about 6.0 Watts of useful power (VmA) out of the standard solar powered panel while the novel fan 1 had approximately 7.0 Watts which would show a better match of load to IV curve for PV panel. The IV curve is the relationship of the current versus voltage characteristics of a photovoltaic cell, module, or array.

The test results simulated those likely seen with two PV (photovoltaic) panels under partly sunny conditions (approximately 11.2 Volts, approximately 1.4 amps).

Tests of the two attic fans were conducted and the results are shown in Table 1. One test was with standard metal blades and a cylindrical housing and the second test used the novel twisted blades 10, 20, 30 and a conical diffuser housing for pressure recovery.

The inventors tested both models as if they were being run by two PV panels wired parallel: 11.2 Volts DC with approximately 1.4 amp current (approximately 15.7 Watts). A calibrated flow plenum was used for the testing.

TABLE 1

| | Fan Type | | |
|---|---|---|---|
| | ConventionalAttic Fan (KF-Fan) | Grainger Fan | Novel Efficient Fan |
| Total CFM | 802 | 1320 | 1043 |
| Total Watts | 22.0 | 200 | 22.0 |
| Total CFM/Watts | 36.4 | 6.6 | 47.4 |

Table 1 further compared the GRAINGER® fan (another fan) as well. Unlike the conventional fan and the novel fan, the GRAINGER® fan used a standard AC shaded pole motor instead of being solar powered.

The standard conventional fan (KofF0) and housing was found to move approximately 802 cfm (cubic feet per minute) at approximately 0.0 external static pressure. The improved fan 1 with the conical diffuser housing moved approximately 1043 cfm at zero static pressure. The novel fan also operated at a lower RPM (revolutions per minute) and was observed to be more quiet than the conventional fan.

The test results represented an approximately 30% increase in flow at the same power. Given that shaft power is increasing between the square and the cube of the air mass flow, this presents about an approximately 90% increase in the work being accomplished.

The GRAINGER® catalogue shows that comparable AC attic vent fans provide about 1320 cfm@200 Watts of AC power. The GRAINGER® attic vent fan retails for about $50, but that doesn't include the cost for an electrician to wire them up. Assuming that the AC attic fans might be operating 10 hours per day, the solar fans would be saving about $6 a month compared to a conventional AC powered one.

The prototype diffuser used with the novel fan had the following dimensions: Narrow point in diffuser throat: 15.5 inches; Fan diameter: approximately 15 inches; Tip clearance: approximately 0.25 inches; Overall height of diffuser: approximately 13.75 inches (can shorten to about 12.75 inches with lip to inlet bell); Exhaust diameter: approximately 17.25 inches; and Inlet diameter: approximately 16.0 inches. The region in the diffuser where the fan sweeps (about 4 inches in height as indicated by the hub) should be the narrowest section (approximately 15.5 inches). Above that the diffuser smoothly increases in diameter to 17.25 inches. The diffusers has an optimal angle of divergence of 7-10 degrees.

In summary, the novel fan 1 can generate airflow of at least approximately 900 cfm (cubic feet per minute) from the rotating blades while running the fan with the twisted blades and the motor at an efficiency of at least approximately 60 CFM per watt. The blades can be rotated up to approximately 500 RPM while generating an airflow of at least approximately 1000 cfm and up to at least approximately 1040 cfm or more.

Portable Fan

Figure 10:
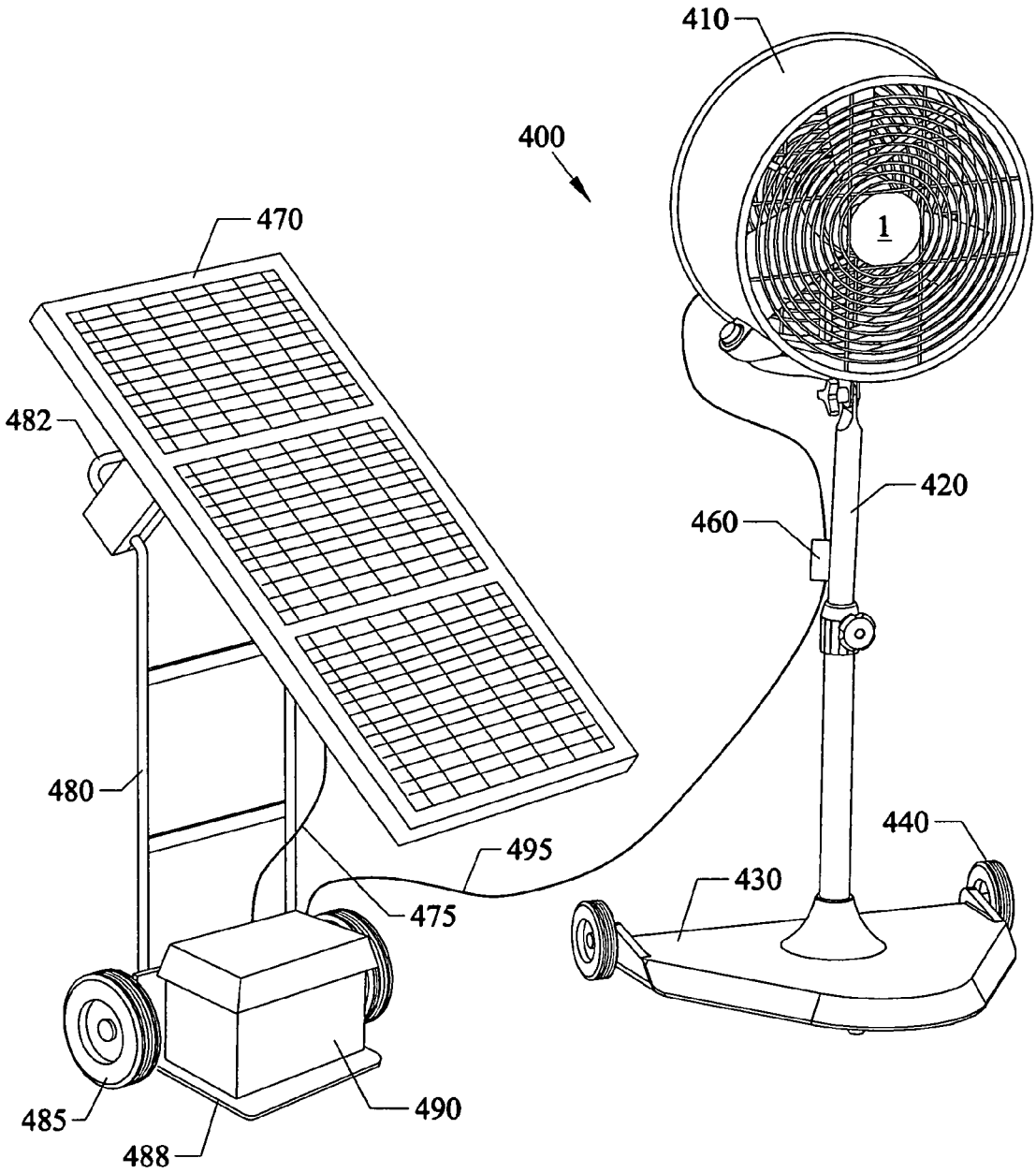
FIG. 10 is a perspective front view of a portable fan incorporating the fan and blades of the preceding figures with a solar power source.
Figure 11:
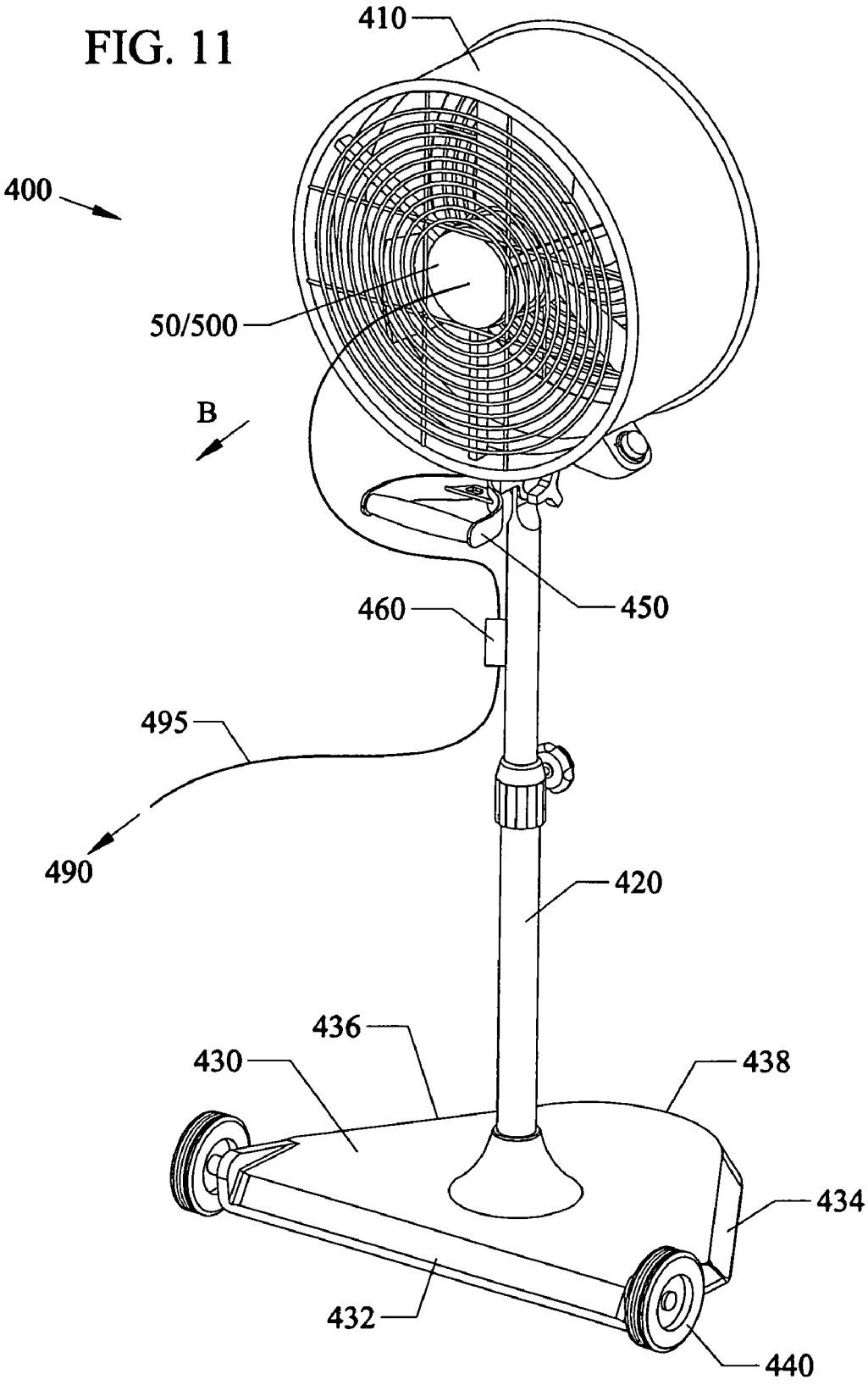
FIG. 11 is a rear view of the portable fan of FIG. 10.

FIG. 10 is a perspective front view of a portable fan 400 incorporating the fan 1 and blades 10, 20, 30 of the preceding figures with a solar power source 470. FIG. 11 is a rear view of the portable fan 400 of FIG. 10. The portable fan embodiment 400 combines a high efficiency fan 1 in a cylindrical housing 410 with a portable stand that can consist of a telescopingly height adjustable pole 420 with triangular shaped base 430 having wheels 440. The triangularly shaped base 430 can have a rear generally straight edge 432 with wheels 440 mounted at each end, angled sides 434, 436 meeting at a rounded apex 438. The shape of the base 430 allows the fan 400 to be easily tilted back in the direction of arrow B so that a user can move the fan 400 with only two wheels 440 by gripping the handle 450 that is attached to the upper pole 420 of the portable fan 400.

A handtruck type stand 480 having an L-shape with wheels 485 on the lower end and hand rails 482 can support solar power panels (PV array) 470, with a battery 490 on the lower ledge 488. The battery power supply 490 can be connected by a power cable 475 to the photovoltaic (PV array) 470 where it becomes a PV powered charger that can be connected by another cable 495 to controls 460 to supply power to the fan 1 on the fan stand 420. The fan 400 can be moved for portable cooling anywhere outdoors where the cable line 495 can be extended up to approximately 50 feet or more in length, from the PV powered charger. Similar to the preceding embodiments, the fan 1 and blades 10, 20, 30 can have optimized twist and airfoil as previously described to improve air moving performance.

The outdoor portable fan 400 can also use a high-efficiency brush-less DC motor 500 instead of the previously described motor 50 and can be hooked to a 30 Watt PV panel 470 charging two sealed lead acid 17.2 amp-hr gel cells in the battery 490. As previously described, a power cord 495 can allow the fan 400 to be located up to approximately 50 feet or more from the solar powered panels (PV) 470. Although the fan can be used outdoors, the cord 495 allows the fan 400 to be able to be used indoors with the PV panels located outdoors.

Fan speed of the DC motor 500 or the basic motor 50 can be modulated with a knob altered pulse width modulated (PWM) or resistance based control 460 to accordingly adjust speeds.

With the invention using the more efficient fan it is possible to move more air than conventional portable fans. It is possible to run the fan longer on a limited battery pack or to use smaller and less expensive PV panels with the invention.

The novel portable fan can be operated where no electric power is available, such as in remote locations or with disaster relief (post hurricane/post earthquake environments). The portable fan can have use in construction sites, at picnics and other outings, on camping, hiking and fishing trips at the beach, and can be used both during the day and at night.

At full speed, the fan 400 can draw approximately 1.4 amps at approximately 11 volts (approximately 15 Watts). At half speed, the fan 400 can draw approximately 5 Watts. With its 34 amp per hour backup, the fan can operate for approximately 11 hours with an approximate 50% discharge with no sun. The fan 400 can use the plastic molded blades previously described and as a result can be more efficient than metal blades.

With an average of approximately 6 hours of sun per day, the portable fan 400 can potentially provide a continuous eight hours of daily operation at full speed, and a continuous 24 hours of operation at half speed.

While the preferred embodiments describe the fan as having plastic blades and a plastic hub molded into a single unit, the invention can have separate blades attached to a separate hub.

While the blades are described as preferably being made from plastic, the blades can be made from metal such as but not limited to aluminum, galvanized metal, steel, and the like.

Although the preferred embodiments show the fan with three twisted blades, the invention can apply to fans having two blades, four blades or more.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A high efficiency ventilation fan for use with a roof, comprising:

a motor; and a hub with only three twisted blades equally spaced apart from one another extending outward therefrom, the hub and the three twisted blades being formed from a single molded unit, with the hub attached to the motor, each of the three twisted blades having a continuous positive twist between a root end and a tip end;

a mount adjacent to a roof for allowing the ventilation fan to exhaust air from beneath the roof; and a solar powered source for supplying power to the motor; and an output from the ventilation fan having an airflow of approximately 1043 cfm while the blades are operating at up to approximately 500 rpm, and the motor drawing power at 22 Watts, with a motor efficiency of approximately 47.4 CFM/Watt.

2. The ventilation fan of claim 1, further comprising:

a diameter across tip ends of the blades of approximately 15 inches.

3. The ventilation fan of claim 2, wherein each of the twisted blades has a length of approximately 5 inches long between the root end and the tip end.

4. The ventilation fan of claim 1, wherein the mount includes:

a housing having a cylindrical portion for mounting the blades and motor therein, the housing having a first end for attachment to a space underneath the roof and having a second exhaust end; and a conical diffuser portion extending above the cylindrical portion of the housing adjacent to the exhaust end of the housing.

5. The ventilation fan of claim 1, wherein each of the twisted blades includes:

a lower concave curved surface between the root end and the tip end; and an upper convex curved surface between the root end and the tip end.

6. The ventilation fan of claim 5, wherein each of the twisted blades includes: a leading edge section between the root end and the tip end being continuously thicker than a trailing edge section that is between the root end and the tip end.

7. The ventilation fan of claim 6, wherein each of the twisted blades has a greater degree of positive twist at the root end than at the tip end.

8. A method of operating a ventilation fan, comprising the steps of:

providing three twisted blades extending from a hub as a single molded unit, each of the twisted blades having a positive continuous twist from each root end to each tip end;

attaching the hub to a motor;

mounting the motor with attached hub and twisted blades adjacent to a roof for exhausting air from underneath the roof;

powering the motor by a solar power source;

rotating the twisted blades up to approximately 500 rpm relative to the motor;

generating an airflow of approximately 1043 cfm (cubic feet per minute) from the rotating blades while drawing power of 22 Watts; and running the fan with the twisted blades and the motor at an efficiency of approximately 47.4 CFM per watt.

9. The method of claim 8, further comprising the steps of:

exhausting air from the fan through a conical diffuser outside of the roof.

10. The method of claim 8, wherein the step of providing the twisted blades includes the step of: providing only three twisted blades each spaced equidistant from one another and extending outward from the hub.

11. The method of claim 10, wherein the step of providing the twisted blades further includes the step of:

providing each of the twisted blades with a lower concave curved surface between the root end and the tip end; and providing each of the twisted blades with an upper convex curved surface between the root end and the tip end.

12. The method of claim 11, wherein the step of providing the twisted blades includes the step of:

providing each of the twisted blades with a leading edge section between the root end and the tip end being continuously thicker than a trailing edge section that is between the root end and the tip end.

13. The method of claim 12, wherein the step of providing the twisted blades includes the step of:

providing each of the twisted blades with a greater degree of positive twist at the root end than at the tip end.

14. A solar powered roof mounted ventilation fan comprising:

an electric motor being run by solar power;

a hub with solely three twisted blades equally spaced apart from one another extending outward from the hub, the hub and the three twisted blades being formed from a single molded unit, with the hub attached to the motor, each of the three twisted blades having a continuous positive twist between a root end and a tip end; and a housing mounted to a roof for allowing the fan to exhaust air from under the roof, the housing having a cylindrical portion for mounting the hub with blades and motor therein, the housing having a conical diffuser portion above the cylindrical portion, wherein the motor with the rotating blades in the housing generates an airflow output of approximately 1043 cfm while the blades are operating at up to approximately 500 rpm, while the motor is drawing power of 22 Watts, with a motor efficiency of approximately 47.4 CFM/Watt.

15. The ventilation fan of claim 14, wherein each of the twisted blades includes:

a lower concave curved surface between the root end and the tip end; and an upper convex curved surface between the root end and the tip end.

16. The ventilation fan of claim 15, wherein each of the twisted blades includes: a leading edge section between the root end and the tip end being continuously thicker than a trailing edge section that is between the root end and the tip end.

17. The ventilation fan of claim 16, wherein each of the twisted blades has a greater degree of positive twist at the root end than at the tip end.

18. The ventilation fan of claim 14, wherein each of the twisted blades has an overall diameter between tips of approximately 15 inches.

19. The ventilation fan of claim 18, wherein each of the twisted blades has a length of approximately 5 inches long between the root end and the tip end.

* * * * *